US009437213B2

(12) United States Patent
Zakarauskas et al.

(10) Patent No.: US 9,437,213 B2
(45) Date of Patent: Sep. 6, 2016

(54) VOICE SIGNAL ENHANCEMENT

(75) Inventors: Pierre Zakarauskas, Vancouver (CA); Alexander Escott, Vancouver (CA); Clarence S. H. Chu, Vancouver (CA); Shawn E. Stevenson, Burnaby (CA)

(73) Assignee: Malaspina Labs (Barbados) Inc., Upton, St. Michael (BB)

( * ) Notice: Subject to any disclaimer, the term of this patent is extended or adjusted under 35 U.S.C. 154(b) by 610 days.

(21) Appl. No.: 13/589,954

(22) Filed: Aug. 20, 2012

(65) Prior Publication Data

US 2013/0231923 A1 Sep. 5, 2013

Related U.S. Application Data

(60) Provisional application No. 61/606,884, filed on Mar. 5, 2012.

(51) Int. Cl.

| | |
|---|---|
| ***G10L 19/14*** | (2006.01) |
| ***G10L 21/0324*** | (2013.01) |
| ***G10L 21/0208*** | (2013.01) |
| ***G10L 21/0308*** | (2013.01) |
| *G10L 21/0364* | (2013.01) |

(52) U.S. Cl.

CPC ..... *G10L 21/0324* (2013.01); *G10L 21/0208* (2013.01); *G10L 21/0308* (2013.01); *G10L 21/0364* (2013.01); *G10L 2021/02082* (2013.01)

(58) Field of Classification Search

CPC ..... G10L 20/02082; G06K 9/00523
USPC ..... 704/205, 226, 225
See application file for complete search history.

(56) References Cited

U.S. PATENT DOCUMENTS

| | | | | |
|---|---|---|---|---|
| 3,989,896 | A | 11/1976 | Reitboeck | |
| 6,104,992 | A | 8/2000 | Gao et al. | |
| 6,199,035 | B1 | 3/2001 | Lakaniemi et al. | |
| 6,252,915 | B1 * | 6/2001 | Mollenkopf et al. | 375/297 |
| 6,611,800 | B1 | 8/2003 | Nishiguchi et al. | |

(Continued)

FOREIGN PATENT DOCUMENTS

WO 03096031 A2 11/2003

OTHER PUBLICATIONS

International Search Report for PCT/IB2013/000805 dated Dec. 12, 2013.

(Continued)

*Primary Examiner* — Jakieda Jackson

(57) ABSTRACT

Implementations include systems, methods and/or devices operable to enhance the intelligibility of a target speech signal by targeted voice model based processing of a noisy audible signal. In some implementations, an amplitude-independent voice proximity function voice model is used to attenuate signal components of a noisy audible signal that are unlikely to be associated with the target speech signal and/or accentuate the target speech signal. In some implementations, the target speech signal is identified as a near-field signal, which is detected by identifying a prominent train of glottal pulses in the noisy audible signal. Subsequently, in some implementations systems, methods and/or devices perform a form of computational auditory scene analysis by converting the noisy audible signal into a set of narrowband time-frequency units, and selectively accentuating the time-frequency units associated with the target speech signal and deemphasizing others using information derived from the identification of the glottal pulse train.

20 Claims, 6 Drawing Sheets

(56) References Cited

U.S. PATENT DOCUMENTS

| | | | | |
|---|---|---|---|---|
| 6,978,235 | B1 | 12/2005 | Ozawa | |
| 7,643,994 | B2 | 1/2010 | Kemp | |
| RE44,157 | E * | 4/2013 | Komara et al. | 455/561 |
| 2001/0021904 | A1 | 9/2001 | Plumpe | |
| 2002/0090915 | A1* | 7/2002 | Komara et al. | 455/69 |
| 2002/0103637 | A1* | 8/2002 | Henn | G10L 21/038 704/206 |
| 2002/0147579 | A1* | 10/2002 | Kushner et al. | 704/207 |
| 2003/0179888 | A1* | 9/2003 | Burnett et al. | 381/71.8 |
| 2004/0052384 | A1* | 3/2004 | Ashley et al. | 381/94.1 |
| 2004/0234079 | A1* | 11/2004 | Schneider et al. | 381/58 |
| 2005/0149321 | A1 | 7/2005 | Kabi et al. | |
| 2006/0020450 | A1* | 1/2006 | Miseki | G10L 19/18 704/219 |
| 2006/0053007 | A1* | 3/2006 | Niemisto | 704/233 |
| 2007/0092089 | A1* | 4/2007 | Seefeldt et al. | 381/104 |
| 2007/0291959 | A1* | 12/2007 | Seefeldt | H03G 3/32 381/104 |
| 2008/0126086 | A1* | 5/2008 | Vos | G10L 19/0208 704/225 |
| 2008/0133225 | A1 | 6/2008 | Yamada | |
| 2009/0240491 | A1 | 9/2009 | Reznik | |
| 2009/0281800 | A1* | 11/2009 | LeBlanc | G10L 21/0208 704/224 |
| 2009/0287481 | A1 | 11/2009 | Paranjpe et al. | |
| 2010/0232616 | A1 | 9/2010 | Chamberlain et al. | |
| 2011/0044405 | A1 | 2/2011 | Sasaki et al. | |
| 2011/0081026 | A1* | 4/2011 | Ramakrishnan et al. | 381/94.3 |
| 2011/0099004 | A1* | 4/2011 | Krishnan | G10L 21/038 704/206 |
| 2011/0280337 | A1* | 11/2011 | Lee et al. | 375/295 |
| 2012/0004909 | A1 | 1/2012 | Beltman et al. | |
| 2012/0076316 | A1* | 3/2012 | Zhu | H04R 3/005 381/71.11 |

OTHER PUBLICATIONS

International Search Report for PCT/IB2013/000802 dated Jan. 23, 2014.

International Search Report for PCT/IB2013/000888 dated May 15, 2014.

* cited by examiner

VOICE SIGNAL ENHANCEMENT

RELATED APPLICATIONS

This application claims the benefit of U.S. Provisional Patent Application No. 61/606,884, entitled "Voice Signal Enhancement," filed on Mar. 5, 2012, and which is incorporated by reference herein.

TECHNICAL FIELD

The present disclosure generally relates to enhancing speech intelligibility, and in particular, to targeted voice model based processing of a noisy audible signal.

BACKGROUND

The ability to recognize and interpret the speech of another person is one of the most heavily relied upon functions provided by the human sense of hearing. But spoken communication typically occurs in adverse acoustic environments including ambient noise, interfering sounds, background chatter and competing voices. As such, the psychoacoustic isolation of a target voice from interference poses an obstacle to recognizing and interpreting the target voice. Multi-speaker situations are particularly challenging because voices generally have similar average characteristics. Nevertheless, recognizing and interpreting a target voice is a hearing task that unimpaired-hearing listeners are able to accomplish effectively, which allows unimpaired-hearing listeners to engage in spoken communication in highly adverse acoustic environments. In contrast, hearing-impaired listeners have more difficultly recognizing and interpreting a target voice even in low noise situations.

Previously available hearing aids typically utilize methods that improve sound quality in terms of the ease of listening (i.e., audibility) and listening comfort. However, the previously known signal enhancement processes utilized in hearing aids do not substantially improve speech intelligibility beyond that provided by mere amplification, especially in multi-speaker environments. One reason for this is that it is particularly difficult, using previously known processes, to electronically isolate one voice signal from competing voice signals in real time because, as noted above, competing voices have similar average characteristics. Another reason is that previously known processes that improve sound quality often degrade speech intelligibility, because, even those processes that aim to improve the signal-to-noise ratio, often end up distorting a target voice signal. In turn, the degradation of speech intelligibility by previously available hearing aids exacerbates the difficulties hearing-impaired listeners have in recognizing and interpreting a target voice signal.

SUMMARY

Various implementations of systems, methods and devices within the scope of the appended claims each have several aspects, no single one of which is solely responsible for the desirable attributes described herein. Without limiting the scope of the appended claims, some prominent features are described herein. After considering this discussion, and particularly after considering the section entitled "Detailed Description" one will understand how the features of various implementations are used to enable enhancing the intelligibility of a target speech signal included in a noisy audible signal received by a hearing aid device or the like.

To that end, some implementations include systems, methods and/or devices operable to enhance the intelligibility of a target speech signal by targeted voice model based processing of a noisy audible signal including the target speech signal. More specifically, in some implementations, an amplitude-independent voice proximity function voice model is used to attenuate signal components of a noisy audible signal that are unlikely to be associated with the target speech signal and/or accentuate the target speech signal. In some implementations, the target speech signal is identified as a near-field signal, which is detected by identifying a prominent train of glottal pulses in the noisy audible signal. Subsequently, in some implementations systems, methods and/or devices perform a form of computational auditory scene analysis by converting the noisy audible signal into a set of narrowband time-frequency units, and selectively accentuating the sub-set of time-frequency units associated with the target speech signal and deemphasizing the other time-frequency units using information derived from the identification of the glottal pulse train.

Some implementations include a method of discriminating relative to a voice signal within a noisy audible signal. In some implementations, the method includes converting an audible signal into a corresponding plurality of wideband time-frequency units. The time dimension of each time-frequency unit includes at least one of a plurality of sequential intervals. The frequency dimension of each time-frequency unit includes at least one of a plurality of wide sub-bands. The method also includes calculating one or more characterizing metrics from the plurality of wideband time-frequency units; calculating a gain function from one or more characterizing metrics; converting the audible signal into a corresponding plurality of narrowband time-frequency units; applying the gain function to the plurality of narrowband time-frequency units to produce a corresponding plurality of narrowband gain-corrected time-frequency units; and converting the plurality of narrowband gain-corrected time-frequency units into a corrected audible signal.

Some implementations include a voice signal enhancement device to discriminate relative to a voice signal within a noisy audible signal. In some implementations, the device includes a first conversion module configured to convert an audible signal into a corresponding plurality of wideband time-frequency units; a second conversion module configured to convert the audible signal into a corresponding plurality of narrowband time-frequency units; a metric calculator configured to calculate one or more characterizing metrics from the plurality of wideband time-frequency units; a gain calculator to calculate a gain function from one or more characterizing metrics; a filtering module configured to apply the gain function to the plurality of narrowband time-frequency units to produce a corresponding plurality of narrowband gain-corrected time-frequency units; and a third conversion module configured to convert the plurality of narrowband gain-corrected time-frequency units into a corrected audible signal.

Additionally and/or alternatively, in some implementations, the device includes means for converting an audible signal into a corresponding plurality of wideband time-frequency units; means for converting the audible signal into a corresponding plurality of narrowband time-frequency units; means for calculating one or more characterizing metrics from the plurality of wideband time-frequency units; means for calculating gain function from one or more characterizing metrics; means for applying the gain function to the plurality of narrowband time-frequency units to produce a corresponding plurality of narrowband gain-corrected time-frequency units; and means for converting the plurality of narrowband gain-corrected time-frequency units into a corrected audible signal.

Additionally and/or alternatively, in some implementations, the device includes a processor and a memory including instructions. When executed, the instructions cause the processor to convert an audible signal into a corresponding plurality of wideband time-frequency units; convert the audible signal into a corresponding plurality of narrowband time-frequency units; calculate one or more characterizing metrics from the plurality of wideband time-frequency units; calculate gain function from one or more characterizing metrics; apply the gain function to the plurality of narrowband time-frequency units to produce a corresponding plurality of narrowband gain-corrected time-frequency units; and convert the plurality of narrowband gain-corrected time-frequency units into a corrected audible signal.

BRIEF DESCRIPTION OF THE DRAWINGS

So that the present disclosure can be understood in greater detail, a more particular description may be had by reference to the features of various implementations, some of which are illustrated in the appended drawings. The appended drawings, however, illustrate only some example features of the present disclosure and are therefore not to be considered limiting, for the description may admit to other effective features.

Figure 1:
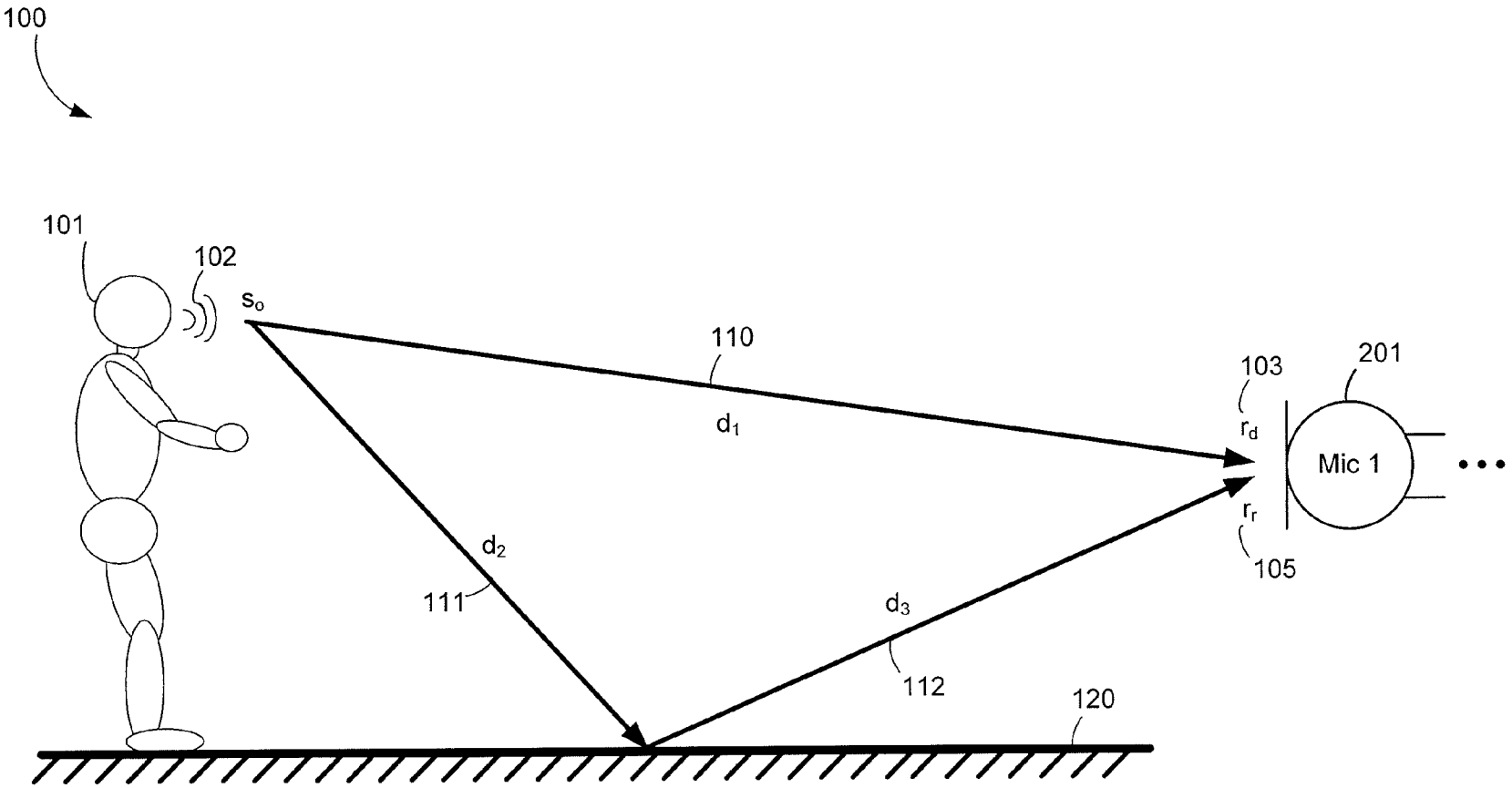
FIG. 1 is a schematic representation of an example auditory scene.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

The various implementations described herein enable enhancing the intelligibility of a target speech signal included in a noisy audible signal received by a hearing aid device or the like. In particular, in some implementations, systems, methods and devices are operable to perform a form of computational auditory scene analysis using an amplitude-independent voice proximity function voice model. For example, in some implementations, a method includes identifying a target speech signal by detecting a prominent train of glottal pulses in the noisy audible signal, converting the noisy audible signal into a set of narrowband time-frequency units, and selectively accentuating the subset of time-frequency units associated with the target speech signal and/or deemphasizing the other time-frequency units using information derived from the identification of the glottal pulse train.

Numerous details are described herein in order to provide a thorough understanding of the example implementations illustrated in the accompanying drawings. However, the invention may be practiced without these specific details. Well-known methods, procedures, components, and circuits have not been described in exhaustive detail so as not to unnecessarily obscure more pertinent aspects of the example implementations.

The general approach of the various implementations described herein is to enable the enhancement of a target speech signal using an amplitude-independent voice proximity function voice model. In some implementations, this approach may enable substantial enhancement of a target speech signal included in a received audible signal over various types of interference included in the same audible signal. In turn, in some implementations, this approach may substantially reduce the impact of various noise sources without substantial attendant distortion and/or a reduction of speech intelligibility common to previously known methods. In particular, in some implementations, a target speech signal is detected by identifying a prominent train of glottal pulses in the noisy audible signal. As described in greater detail below, in accordance with some implementations, the relative prominence of a detected glottal pulse train is indicative of voice activity and generally can be used to characterize the target speech signal as being a near-field signal relative to a listener or sound sensor, such as a microphone. To that end, in some implementations, the detection of voice activity in a noisy signal is enabled by dividing the frequency spectrum associated with human speech into multiple wideband sub-bands in order to identify glottal pulses that dominate noise and/or other inference in particular wideband sub-bands. Glottal pulses may be more pronounced in wideband sub-bands that include relatively higher energy speech formants that have energy envelopes that vary according to glottal pulses.

In some implementations, the detection of glottal pulses is used to signal the presence of voiced speech because glottal pulses are an underlying component of how voiced sounds are created by a speaker and subsequently perceived by a listener. More specifically, glottal pulses are created when air pressure from the lungs is buffeted by the glottis, which periodically opens and closes. The resulting pulses of air excite the vocal tract, throat, mouth and sinuses which act as resonators, so that a resulting voiced sound has the same periodicity as the train of glottal pulses. By moving the tongue and vocal chords the spectrum of the voiced sound is changed to produce speech which can be represented by one or more formants, which are discussed in more detail below. However, the aforementioned periodicity of the glottal pulses remains and provides the perceived pitch of voiced sounds.

The duration of one glottal pulse is representative of the duration of one opening and closing cycle of the glottis, and the fundamental frequency of a series of glottal pulses is approximately the inverse of the interval between two subsequent pulses. The fundamental frequency of a glottal pulse train dominates the perception of the pitch of a voice (i.e., how high or low a voice is perceived to sound). For example, a bass voice has a lower fundamental frequency than a soprano voice. A typical adult male will have a fundamental frequency of ranging from 85 to 155 Hz. A typical adult female will have a fundamental frequency ranging from 165 to 255 Hz. Children and babies have even higher fundamental frequencies. Infants typically have a range of 250 to 650 Hz, and in some cases go over 1000 Hz.

During speech, it is natural for the fundamental frequency to vary within a range of frequencies. Changes in the fundamental frequency are heard as the intonation pattern or melody of natural speech. Since a typical human voice varies over a range of fundamental frequencies, it is more accurate to speak of a person having a range of fundamental frequencies, rather than one specific fundamental frequency. Nevertheless, a relaxed voice is typically characterized by a natural (or nominal) fundamental frequency or pitch that is comfortable for that person. That is, the glottal pulses provide an underlying undulation to voiced speech corresponding to the pitch perceived by a listener.

As noted above, spoken communication typically occurs in the presence of noise and/or other interference. In turn, the undulation of voiced speech is masked in some portions of the frequency spectrum associated with human speech by noise and/or other interference. In some implementations, systems, methods and devices are operable to identify voice activity by identifying the portions of the frequency spectrum associated with human speech that are unlikely to be masked by noise and/or other interference. To that end, in some implementations, systems, method and devices are operable to identify periodically occurring pulses in one or more sub-bands of the frequency spectrum associated with human speech corresponding to the spectral location of one or more respective formants. The one or more sub-bands including formants associated with a particular voiced sound will typically include more energy than the remainder of the frequency spectrum associated with human speech for the duration of that particular voiced sound. But the formant energy will also typically undulate according to the periodicity of the underlying glottal pulses.

Formants are the distinguishing frequency components of voiced sounds that make up intelligible speech. Formants are created by the vocal chords and other vocal tract articulators using the air pressure from the lungs that was first modulated by the glottal pulses. In other words, the formants concentrate or focus the modulated energy from the lungs and glottis into specific frequency bands in the frequency spectrum associated with human speech. As a result, when a formant is present in a sub-band, the average energy of the glottal pulses in that sub-band rises to the energy level of the formant. In turn, when the formant energy is greater than the noise and/or interference, the glottal pulse energy is above the noise and/or interference, and is thus detectable as the time domain envelope of the formant.

Various implementations described herein utilize a formant based voice model because formants have a number of desirable attributes. First, formants allow for a sparse representation of speech, which in turn, reduces the amount of memory and processing power needed in a device such as a hearing aid. For example, some implementations aim to reproduce natural speech with eight or fewer formants. On the other hand, other known model-based voice enhancement methods tend to require relatively large allocations of memory and tend to be computationally expensive.

Second, formants change slowly with time, which means that a formant based voice model programmed into a hearing aid will not have to be updated very often, if at all, during the life of the device.

Third, with particular relevance to voice activity detection and pitch detection, the majority of human beings naturally produce the same set of formants when speaking, and these formants do not change substantially in response to changes or differences in pitch between speakers or even the same speaker. Additionally, unlike phonemes, formants are language independent. As such, in some implementations a single formant based voice model, generated in accordance with the prominent features discussed below, can be used to reconstruct a target voice signal from almost any speaker (speaking in one of a variety of languages) without extensive fitting of the model to each particular speaker a user encounters.

Fourth, also with particular relevance to voice activity detection and pitch detection, formants are robust in the presence of noise and other interference. In other words, formants remain distinguishable even in the presence of high levels of noise and other interference. In turn, as discussed in greater detail below, in some implementations formants are relied upon to raise the glottal pulse energy above the noise and/or interference, making the glottal pulse peaks distinguishable after the processing included in various implementations discussed below.

However, despite the desirable attributes of formants, in a number of acoustic environments even glottal pulses associated with formants can be smeared out by reverberations when the source of speech (e.g., a speaker, TV, radio, etc.) is positioned far enough away from a listener or sound sensor, such as a microphone. Reverberations are reflections or echoes of sound that interfere with the sound signal received directly (i.e., without reflection) from a sound source. Typically, is a speaker is close enough to a listener or sound sensor, reflections of the speaker's voice are not heard because the direct signal is so much more prominent than any reflection that may arrive later in time.

FIG. 1 is a schematic representation of a very simple example auditory scene 100 provided to further explain the impact of reverberations on directly received sound signals. The scene includes a speaker 101, a microphone 201 positioned some distance away from the speaker 101, and a floor surface 120, serving as a sound reflector. The speaker 101 provides an audible speech signal 102, which is received by the microphone 201 along two different paths. The first path is a direct path between the speaker 101 and the microphone 201, and includes a single path segment 110 of distance $d_1$. The second path is a reverberant path, and includes two segments 111, 112, each having a respective distance $d_2$, $d_3$. Those skilled in the art will appreciate that a reverberant path may have two or more segments depending upon the number of reflections the sound signal experiences en route to the listener or sound sensor. And merely for the sake of example, the reverberant path discussed herein includes the two aforementioned segments 111, 112, which is the product of a single reflection off of the floor surface 120.

The signal received along the direct path, namely $r_d$ (103), is referred to as the direct signal. The signal received along the reverberant path, namely $r_r$ (105), is the reverberant signal. The audible signal received by the microphone 201 is the combination of the direct signal $r_r$ and the reverberant signal $r_d$. The distance, $d_1$, within which the amplitude of the direct signal $|r_d|$ surpasses that of the highest amplitude reverberant signal $|r_r|$ is known as the near-field. Within that distance the direct-to-reverberant ratio is typically greater than unity and the direct path dominates. This is where the glottal pulses of the speaker 101 are prominent in the received audible signal. That distance depends on the size and the acoustic properties of the room the listener is in. In general, rooms having larger dimensions are characterized by longer cross-over distances, whereas rooms having smaller dimensions are characterized by smaller cross-over distances.

As noted above, some implementations include systems, methods and/or devices that are operable to perform a form of computational auditory scene analysis on a noisy signal in order to enhance a target voice signal included therein. And with reference to the example scene provided in FIG. 1, in some implementations, the voice activity detector described below with reference to FIG. 2 also serves as a single-channel amplitude-independent signal proximity discriminator. In other words, the voice activity detector is configured to select a target voice signal at least in part because the speaker (or speech source) is within a near-field relative to a hearing aid or the like. That is, the target voice signal includes a direct path signal that dominates an associated reverberant path signal, which is a scenario that typically corresponds to an arrangement in which the speaker and listener are relatively close to one another (i.e., with a respective near-field relative to one another). This may be especially useful in situations in which a hearing-impaired listener, using a device implemented as described herein, engages in spoken communication with a nearby speaker in a noisy room (i.e., the cocktail party problem).

Figure 2:
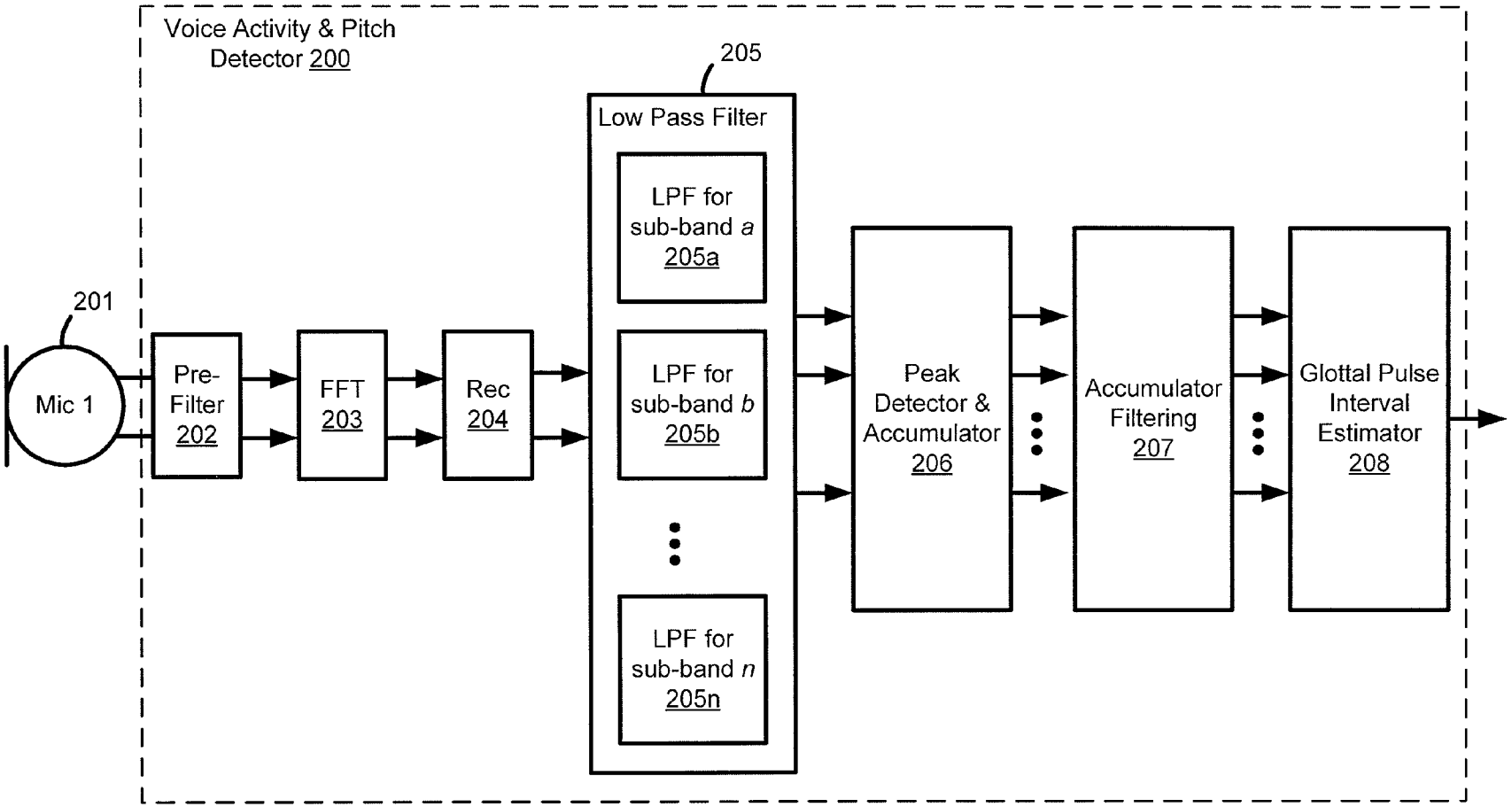
FIG. 2 is a block diagram of an implementation of a voice activity and pitch estimation system.

FIG. 2 is a block diagram of an implementation of a voice activity and pitch estimation system 200. While certain specific features are illustrated, those skilled in the art will appreciate from the present disclosure that various other features have not been illustrated for the sake of brevity and so as not to obscure more pertinent aspects of the example implementations disclosed herein. To that end, as a non-limiting example, in some implementations the voice activity and pitch estimation system 200 includes a pre-filtering stage 202 connectable to the microphone 201, a Fast Fourier Transform (FFT) module 203, a rectifier module 204, a low-pass filtering module 205, a peak detector and accumulator module 206, an accumulation filtering module 206, and a glottal pulse interval estimator 208.

In some implementations, the voice activity and pitch estimation system 200 is configured for utilization in a hearing aid or similar device. Briefly, in operation the voice activity and pitch estimation system 200 detects the peaks in the envelope in a number of sub-bands, and accumulates the number of pairs of peaks having a given separation. In some implementations, the aforementioned separations are associated with a number of sub-ranges (e.g., 1 Hz wide "bins") that are used to break-up the frequency range of human pitch (e.g., 85 Hz to 255 Hz for adults). The accumulator output is then smoothed, and the location of a peak in the accumulator indicates the presence of voiced speech. In other words, the voice activity and pitch estimation system 200 attempts to identify the presence of regularly-spaced transients generally corresponding to glottal pulses characteristic of voiced speech. In some implementations, the transients are identified by relative amplitude and relative spacing.

To that end, in operation, an audible signal is received by the microphone 201. The received audible signal may be optionally conditioned by the pre-filter 202. For example, pre-filtering may include band-pass filtering to isolate and/or emphasize the portion of the frequency spectrum associated with human speech. Additionally and/or alternatively, pre-filtering may include filtering the received audible signal using a low-noise amplifier (LNA) in order to substantially set a noise floor. Those skilled in the art will appreciate that numerous other pre-filtering techniques may be applied to the received audible signal, and those discussed are merely examples of numerous pre-filtering options available.

In turn, the FFT module 203 converts the received audible signal into a number of time-frequency units, such that the time dimension of each time-frequency unit includes at least one of a plurality of sequential intervals, and the frequency dimension of each time-frequency unit includes at least one of a plurality of sub-bands contiguously distributed throughout the frequency spectrum associated with human speech. In some implementations, a 32 point short-time FFT is used for the conversion. However, those skilled in the art will appreciate that any number of FFT implementations may be used. Additionally and/or alternatively, in some implementations a bank (or set) of filters may be used instead of the FFT module 203. For example, a bank of IIR filters may be used to achieve the same or similar result.

The rectifier module 204 is configured to produce an absolute value (i.e., modulus value) signal from the output of the FFT module 203 for each sub-band.

The low pass filtering stage 205 includes a respective low pass filter 205*a*, 205*b*, . . . , 205*n* for each of the respective sub-bands. The respective low pass filters 205*a*, 205*b*, . . . , 205*n* filter each sub-band with a finite impulse response filter (FIR) to obtain the smooth envelope of each sub-band. The peak detector and accumulator 206 receives the smooth envelopes for the sub-bands, and is configured to identify sequential peak pairs on a sub-band basis as candidate glottal pulse pairs, and accumulate the candidate pairs that have a time interval within the pitch period range associated with human speech. In some implementations, accumulator also has a fading operation (not shown) that allows it to focus on the most recent portion (e.g., 20 msec) of data garnered from the received audible signal.

The accumulation filtering module 207 is configured to smooth the accumulation output and enforce filtering rules and temporal constraints. In some implementations, the filtering rules are provided in order to disambiguate between the possible presence of a signal indicative of a pitch and a signal indicative of an integer (or fraction) of the pitch. In some implementations, the temporal constraints are used to reduce the extent to which the pitch estimate fluctuates too erratically.

The glottal pulse interval estimator 208 is configured to provide an indicator of voice activity based on the presence of detected glottal pulses and an indicator of the pitch estimate using the output of the accumulator filtering module 207.

Moreover, FIG. 2 is intended more as functional description of the various features which may be present in a particular implementation as opposed to a structural schematic of the implementations described herein. In practice, and as recognized by those of ordinary skill in the art, items shown separately could be combined and some items could be separated. For example, some functional blocks shown separately in FIG. 2 could be implemented in a single module and the various functions of single functional blocks (e.g., peak detector and accumulator 206) could be implemented by one or more functional blocks in various implementations. The actual number of modules and the division of particular functions used to implement the voice activity and pitch estimation system 200 and how features are allocated among them will vary from one implementation to another, and may depend in part on the particular combination of hardware, software and/or firmware chosen for a particular implementation.

Figure 3:
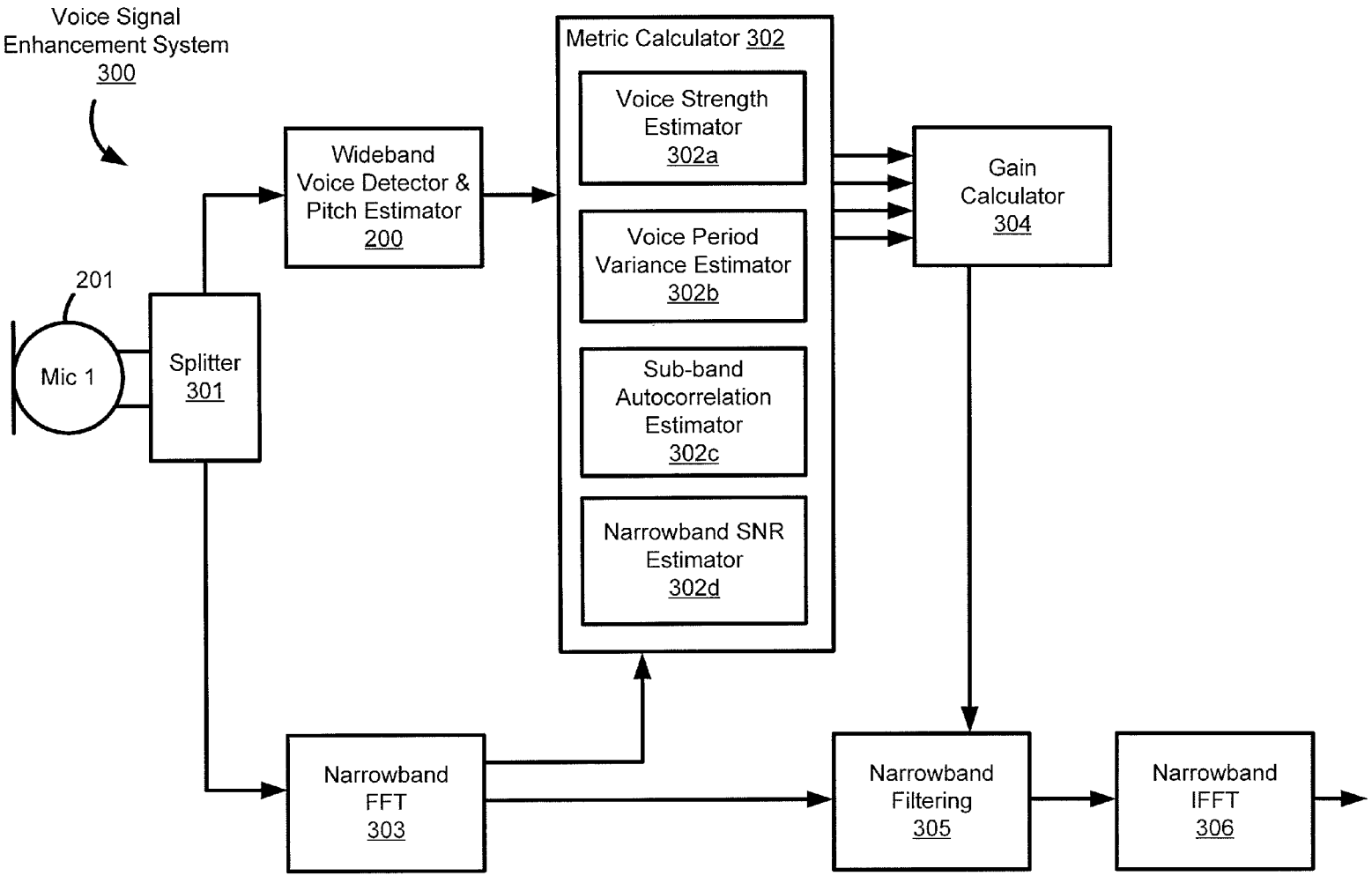
FIG. 3 is a block diagram of a voice signal enhancement system.

FIG. 3 is a block diagram of a voice signal enhancement system 300. While certain specific features are illustrated, those skilled in the art will appreciate from the present disclosure that various other features have not been illustrated for the sake of brevity and so as not to obscure more pertinent aspects of the example implementations disclosed herein. To that end, as a non-limiting example, in some implementations the voice signal enhancement system 300 includes the microphone 201, a signal splitter 301, the voice detector and pitch estimator 200, a metric calculator 302, a gain calculator 304, a narrowband FFT module 303, a narrowband filtering module 305, and a narrowband IFFT module 306.

The splitter 301 defines two substantially parallel paths within the voice signal enhancement system 300. The first path includes the voice detector and pitch estimator 200, the metric calculator 302 and the gain calculator 304 coupled in series. The second path includes the narrowband FFT module 303, the narrowband filtering module 305, and the narrowband IFFT modules 306 coupled in series. The two paths provide inputs to one another. For example, as discussed in greater detail below, in some implementations, the output of the narrowband FFT module 303 is utilized by the metric calculator 302 to generate estimates of the signal-to-noise (SNR) in each narrowband sub-band in a noise tracking process. Additionally, the output of the gain calculator 304 is utilized by the narrowband filtering module 305 to selectively accentuate the narrowband time-frequency units associated with the target speech signal and deemphasize others using information derived from the identification of the glottal pulse train by the voice detector and pitch estimator 200.

In some implementations, with additional reference to FIG. 2, the FFT module 203, included in the voice detector and pitch estimator 200, is configured to generate relatively wideband sub-band time-frequency units relative to the time-frequency units generated by the narrowband FFT module 303. To similar ends, in some implementations, a first conversion module is provided to convert an audible signal into a corresponding plurality of wideband time-frequency units, where the time dimension of each time-frequency unit includes at least one of a plurality of sequential intervals, and where the frequency dimension of each time-frequency unit includes at least one of a plurality of wide sub-bands.

In some implementations, the narrowband FFT module 303 converts the received audible signal into a number of narrowband time-frequency units, such that the time dimension of each narrowband time-frequency unit includes at least one of a plurality of sequential intervals, and the frequency dimension of each narrowband time-frequency unit includes at least one of a plurality of sub-bands contiguously distributed throughout the frequency spectrum associated with human speech. As noted above, the sub-bands produced by the narrowband FFT module 303 are relatively narrow as compared to the sub-bands produced by the wideband FFT module 203. In some implementations, a 32 point short-time FFT is used for the conversion. In some implementations, a 128 point FFT can be used. However, those skilled in the art will appreciate that any number of FFT implementations may be used. Additionally and/or alternatively, in some implementations a bank (or set) of filters may be used instead of the narrowband FFT module 303. For example, a bank of IIR filters may be used to achieve the same or similar result.

In some implementations, the metric calculator 302 is configured to include one or more metric estimators. In some implementations, each of the metric estimates is substantially independent of one or more of the other metric estimates. As illustrated in FIG. 3, the metric calculator 302 includes four metric estimators, namely, a voice strength estimator 302*a*, a voice period variance estimator 302*b*, a sub-band autocorrelation estimator 302*c*, and a narrowband SNR estimator 302*d*.

Figure 6A:
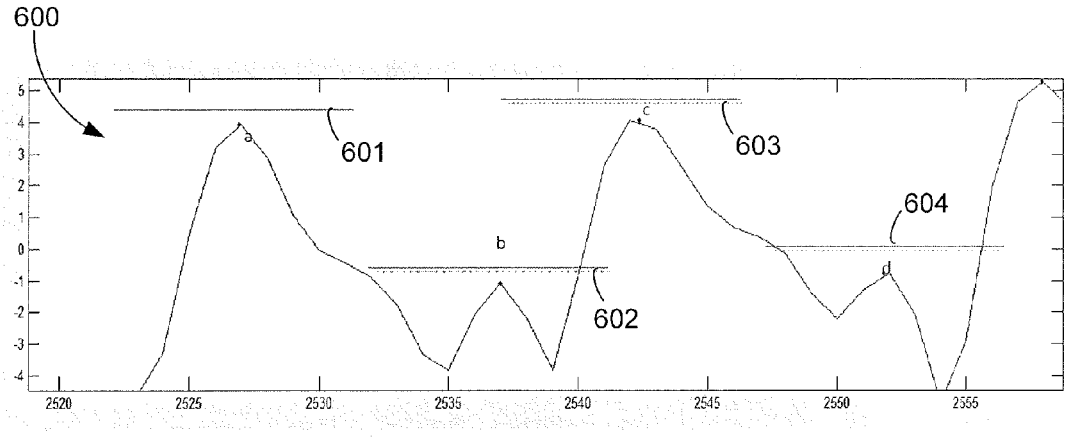
FIG. 6A is a time domain representation of a smoothed envelope of one sub-band of a voice signal.

In some implementations, the voice strength estimator 302*a* is configured to provide an indicator of the relative strength of the target voice signal. In some implementations, the relative strength is measured by the number of detected glottal pulses, which are weighted by respective correlation coefficients. In some implementations, the relative strength indicator includes the highest detected amplitude of the smoothed inter-peak interval accumulation produced by the accumulator function of the voice activity detector. For example, FIG. 6A is a time domain representation of an example smoothed envelope 600 of one sub-band of a voice signal, including four local peaks a, b, c, and d. The respective bars 601, 602, 603, 604 centered on each local peak indicates the range over which an autocorrelation coefficient ρ is calculated. For example, the value of ρ for the pair [ab] for example is calculated by comparing the time series in the interval around a with that around b. The value of ρ will be small for pairs [ab], [ad], and [bc] but close to unity for pairs [ac] and [bd]. The value of ρ for each pair is summed in an inter-peak interval accumulation (IPIA) in a bin corresponding to the inter-pair interval. In this example, the intervals [ac] and [bd] corresponds to the interval between glottal pulses, the inverse of which is the pitch of the voice.

Figure 6B:
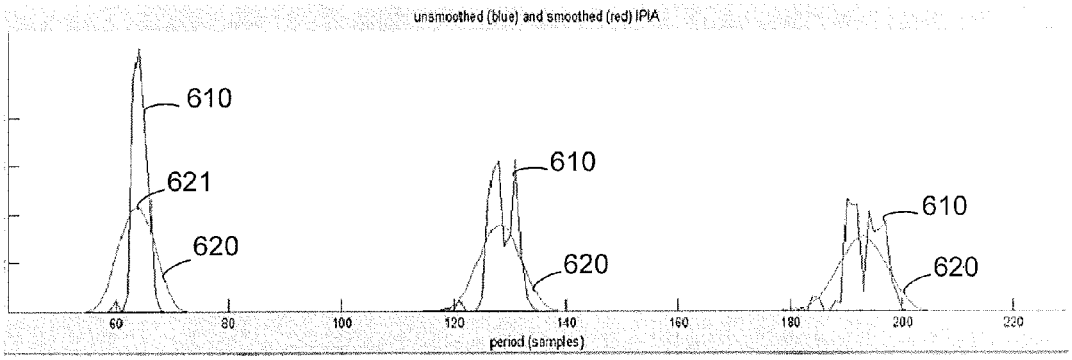
FIG. 6B is a time domain representation of a raw and a corresponding smoothed inter-peak interval accumulation for voice data.
Figure 6C:
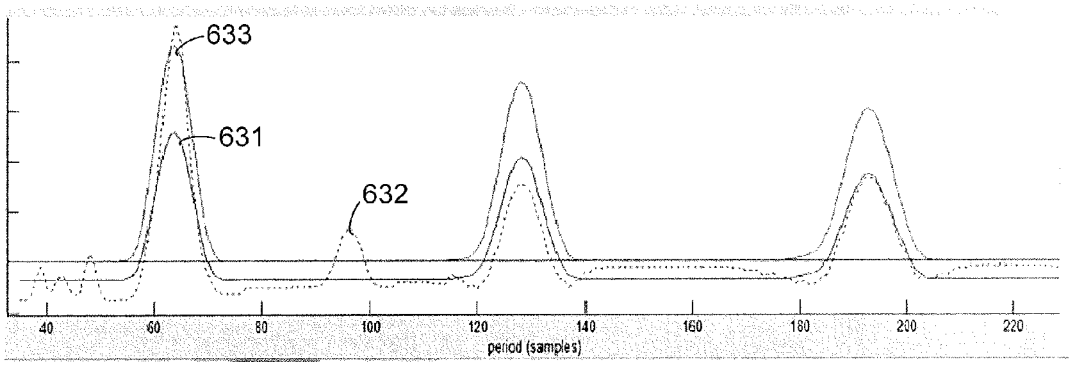
FIG. 6C is a time domain representation of the output of a rules filter.

FIG. 6B is a time domain representation of a raw and a corresponding smoothed inter-peak interval accumulation 610, 620 for voice data. In some implementations, before adding the new data at each frame, the IPIA from the last frame is first multiplied by a constant less than unity, thereby implementing a leaky integrator. As shown in FIG. 6B, there are three peaks corresponding to the real period, twice the real period, and three times the real period. The ambiguity resulting from these multiples is resolved by a voice activity detector to obtain the correct pitch. In order to disambiguate the multiples, the IPIA is zero-meaned, as represented by 631 in FIG. 6C, and filtered by a set of rules, as discussed above and represented by 632 in FIG. 6C. In turn, the amplitude of the highest peak 633 is used to determine the relative strength indicator and as the dominant voice period P, as shown in FIG. 6C.

In some implementations, the voice period variance estimator 302*b* is configured to estimate the pitch variance in each wideband sub-band. In other words, the voice period variance estimator 302*b* provides an indicator for each sub-band that indicates how far the period detected in a sub-band is from the dominant voice period P. In some implementations the variance indicator for a particular wideband sub-band is determined by keeping track of a period estimate derived from the glottal pulses detected in that particular sub-band, and comparing the respective pitch estimate with the dominant voice period P.

In some implementations, the sub-band autocorrelation estimator 302*c* is configured to provide an indication of the highest autocorrelation for each for each wideband sub-band. In some implementations, a sub-band autocorrelation indicator is determined by keeping track of the highest autocorrelation coefficient ρ for a respective wideband sub-band.

In some implementations, the narrowband SNR estimator 302*d* is configured to provide an indication of the SNR in each narrowband sub-band generated by the narrowband FFT module 303.

In some implementations, the gain calculator 304 is configured to convert the one or more metric estimates provided by the metric calculator 302 into one or more time and/or frequency dependent gain values or a combined gain value that can be used to filter the narrowband time-frequency units produced by the narrowband FFT module 303. For example, for one or more of the metrics discussed above, a gain in the interval [0, 1] is generated separately by the use of a sigmoid function. With respect to an autocorrelation value ρ for a particular sub-band, if ρ=0.5, then the gain would be 0.5. Similarly, corresponding gains are obtained by using one or more sigmoid functions for each metric or indicator, each with its own steepness and center parameters.

In turn, the narrowband filtering module 305 applies the gains to the narrowband time-frequency units generated by the FFT module 303. In some implementations, the total gain to be applied to the narrowband time-frequency units is the weighted average of the individual gains, although other ways to combine them would also do, such as their product, or geometrical average. Moreover, in some implementations, a combined gain may be used in low frequency sub-bands, where vowels are likely to dominate. In some implementations, there may be improvements achievable by using a separate rule to generate and/or apply the gains in the high frequency sub-bands. For example, a high frequency gain may be generated by the combination of two gains, such as a gain value derived from the SNR of a high frequency sub-band and another gain derived from the observation that consonants in some high frequency bands tend to not occur at the same time as voiced speech, but in between voiced speech. As such, the VAD-based high frequency gain turns on when the VAD-based low frequency gain turns off, and remains open until either the VAD indicates speech again, or until a given maximum period is reached. Subsequently, the narrowband IFFT module 306 converts the filtered narrowband time-frequency units back into an audible signal.

In some implementations, the voice signal enhancement system 300 is configured for utilization in and/or as a hearing aid or similar device. Moreover, FIG. 3 is intended more as functional description of the various features which may be present in a particular implementation as opposed to a structural schematic of the implementations described herein. In practice, and as recognized by those of ordinary skill in the art, items shown separately could be combined and some items could be separated. For example, some functional blocks shown separately in FIG. 3 could be implemented in a single module and the various functions of single functional blocks (e.g., metric calculator 302) could be implemented by one or more functional blocks in various implementations. The actual number of modules and the division of particular functions used to implement the voice signal enhancement system 300 and how features are allocated among them will vary from one implementation to another, and may depend in part on the particular combination of hardware, software and/or firmware chosen for a particular implementation.

Figure 4:
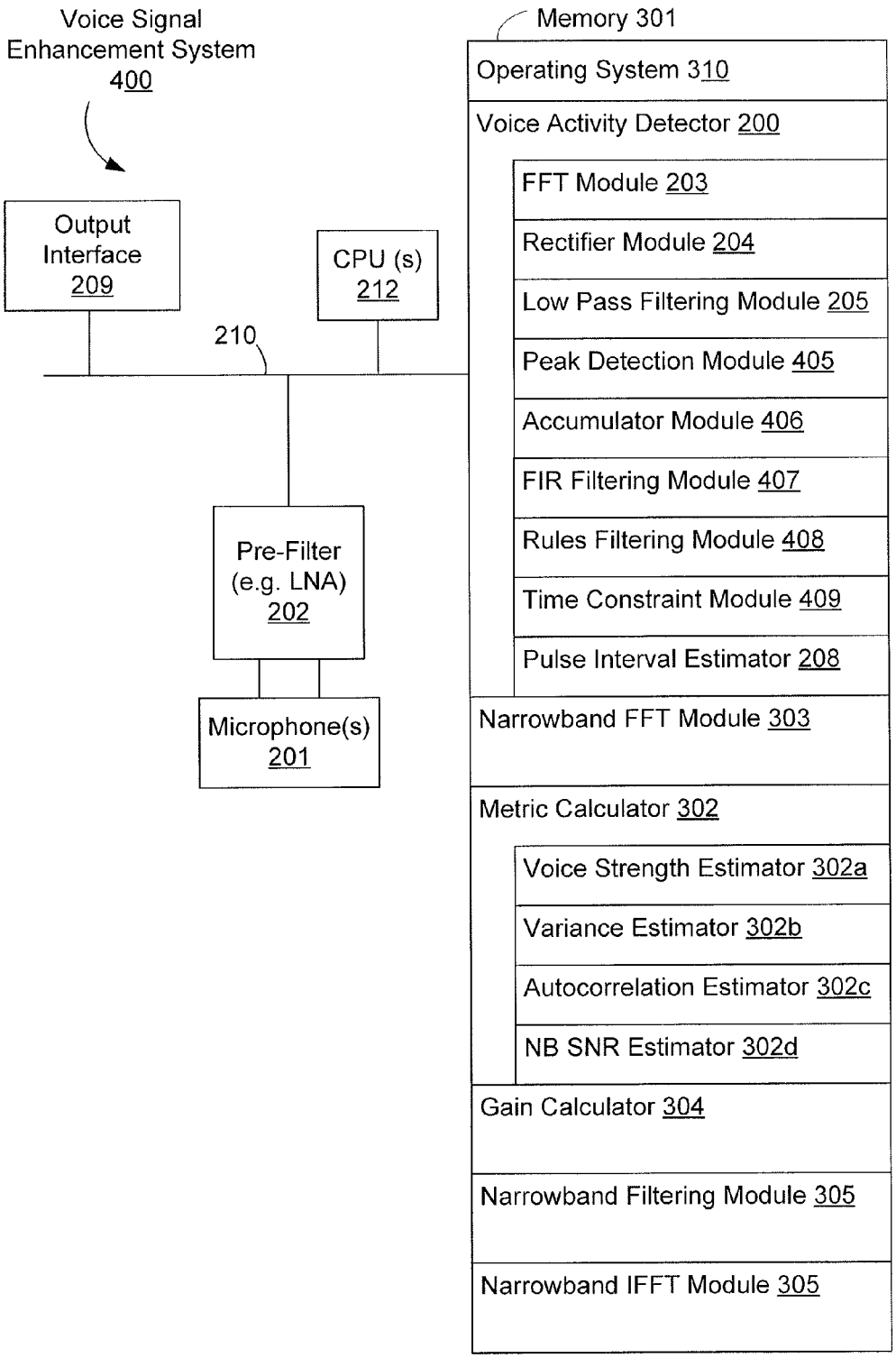
FIG. 4 is a block diagram of a voice signal enhancement system.

FIG. 4 is block diagram of a voice signal enhancement system 400. The voice signal enhancement system 400 illustrated in FIG. 4 is similar to and adapted from the voice signal enhancement system 300 illustrated in FIG. 3, and includes features of the voice activity and pitch estimation system 200 illustrated in FIG. 2. Elements common to each of FIG. 2-4 include common reference numbers, and only the differences between FIGS. 2-4 are described herein for the sake of brevity. Moreover, while certain specific features are illustrated, those skilled in the art will appreciate from the present disclosure that various other features have not been illustrated for the sake of brevity, and so as not to obscure more pertinent aspects of the implementations disclosed herein.

To that end, as a non-limiting example, in some implementations the voice signal enhancement system 400 includes one or more processing units (CPU's) 212, one or more output interfaces 209, a memory 301, the pre-filter 202, the microphone 201, and one or more communication buses 210 for interconnecting these and various other components.

The communication buses 210 may include circuitry that interconnects and controls communications between system components. The memory 301 includes high-speed random access memory, such as DRAM, SRAM, DDR RAM or other random access solid state memory devices; and may include non-volatile memory, such as one or more magnetic disk storage devices, optical disk storage devices, flash memory devices, or other non-volatile solid state storage devices. The memory 301 may optionally include one or more storage devices remotely located from the CPU(s) 212. The memory 301, including the non-volatile and volatile memory device(s) within the memory 301, comprises a non-transitory computer readable storage medium. In some implementations, the memory 301 or the non-transitory computer readable storage medium of the memory 301 stores the following programs, modules and data structures, or a subset thereof including an optional operating system 310, the voice activity and pitch estimation module 200, the narrowband FFT module 303, the metric calculator module 302, the gain calculator module 304, the narrowband filtering module 305, and the narrowband IFFT module 305.

The operating system 310 includes procedures for handling various basic system services and for performing hardware dependent tasks.

In some implementations, the voice activity and pitch estimation module 200 includes the FFT module 203, the rectifier module 204, low-pass filtering module 205, a peak detection module 405, an accumulator module 406, an FIR filtering module 407, a rules filtering module 408, a time-constraint module 409, and the glottal pulse interval estimator 208.

In some implementations, the FFT module 203 is configured to convert an audible signal, received by the microphone 201, into a set of time-frequency units as described above. As noted above, in some implementations, the received audible signal is pre-filtered by pre-filter 202 prior to conversion into the frequency domain by the FFT module 203. To that end, in some implementations, the FFT module 203 includes a set of instructions and heuristics and metadata.

In some implementations, the rectifier module 204 is configured to produce an absolute value (i.e., modulus value) signal from the output of the FFT module 203 for each sub-band. To that end, in some implementations, the rectifier module 204 includes a set of instructions and heuristics and metadata.

In some implementations, the low pass filtering module 205 is operable to low pass filter the time-frequency units that have been produced by the FFT module 203 and rectified by the rectifier module 204 on a sub-band basis. To that end, in some implementations, the low pass filtering module 205 includes a set of instructions and heuristics and metadata.

In some implementations, the peak detection module 405 is configured to identify sequential spectral peak pairs on a sub-band basis as candidate glottal pulse pairs in the smooth envelope signal for each sub-band provided by the low pass filtering module 205. In other words, the peak detection module 405 is configured to search for the presence of regularly-spaced transients generally corresponding to glottal pulses characteristic of voiced speech. In some implementation, the transients are identified by relative amplitude and relative spacing. To that end, in some implementations, the peak detection module 405 includes a set of instructions and heuristics and metadata.

In some implementations, the accumulator module 406 is configured to accumulator the peak pairs identified by the peak detection module 405. In some implementations, accumulator module also is also configured with a fading operation that allows it to focus on the most recent portion (e.g., 20 msec) of data garnered from the received audible signal. To these ends, in some implementations, the accumulator module 406 includes a set of instructions and heuristics and metadata.

In some implementations, the FIR filtering module 407 is configured to smooth the output of the accumulator module 406. To that end, in some implementations, the FIR filtering module 407 includes a set of instructions and heuristics and metadata. Those skilled in the art will appreciated that the FIR filtering module 407 may be replaced with any suitable low passing filtering module, including for example, an IIR (infinite impulse response) filtering module configured to provide low pass filtering.

In some implementations, the rules filtering module 408 is configured to disambiguate between the actual pitch of a target voice signal in the received audible signal and integer multiples (or fractions) of the pitch. Analogously, rules filtering module 408 performs a form of anti-aliasing on the FIR filtering module 407. To that end, in some implementations, the rules filtering module 408 includes a set of instructions and heuristics and metadata.

In some implementations, the time constraint module 409 is configured to limit or dampen fluctuations in the estimate of the pitch. To that end, in some implementations, the time constraint module 409 includes a set of instructions and heuristics and metadata.

In some implementations, the pulse interval module 208 is configured to provide an indicator of voice activity based on the presence of detected glottal pulses and an indicator of the pitch estimate using the output of the time constraint module 409. To that end, in some implementations, the pulse interval module 208 includes a set of instructions and heuristics and metadata.

In some implementations, the narrowband FFT module 303 is configured to convert the received audible signal into a number of narrowband time-frequency units, such that the time dimension of each narrowband time-frequency unit includes at least one of a plurality of sequential intervals, and the frequency dimension of each narrowband time-frequency unit includes at least one of a plurality of sub-bands contiguously distributed throughout the frequency spectrum associated with human speech. As noted above, the sub-bands produced by the narrowband FFT module 303 are relatively narrow as compared to the sub-bands produced by the wideband FFT module 203. To that end, in some implementations, the narrowband FFT module 303 includes a set of instructions and heuristics and metadata.

In some implementations, the metric calculator module 302 is configured to include one or more metric estimators, as described above. In some implementations, each of the metric estimates is substantially independent of one or more of the other metric estimates. As illustrated in FIG. 4, the metric calculator module 302 includes four metric estimators, namely, a voice strength estimator 302*a*, a voice period variance estimator 302*b*, a sub-band autocorrelation estimator 302*c*, and a narrowband SNR estimator 302*d*, each with a respective set of instructions and heuristics and metadata.

In some implementations, the gain calculator module 304 is configured to convert the one or more metric estimates provided by the metric calculator 302 into one or more time and/or frequency dependent gain values or a combined gain value. To that end, in some implementations, the gain calculator module 304 includes a set of instructions and heuristics and metadata.

In some implementations, the narrowband filtering module 305 is configured to apply the one or more gains to the narrowband time-frequency units generated by the FFT module 303. To that end, in some implementations, the narrowband filtering module 305 includes a set of instructions and heuristics and metadata.

In some implementations, the narrowband IFFT module 305 is configured to convert the filtered narrowband time-frequency units back into an audible signal. To that end, in some implementations, the narrowband IFFT module 305 includes a set of instructions and heuristics and metadata. Additionally and/or alternatively, if the FFT module 303 is replaced with another different module, such as for example, a bank of IIR filters, then the narrowband IFFT module 305 could be replaced with a time series adder, to add the time series from each sub-band to produce the output.

Moreover, FIG. 4 is intended more as functional description of the various features which may be present in a particular implementation as opposed to a structural schematic of the implementations described herein. In practice, and as recognized by those of ordinary skill in the art, items shown separately could be combined and some items could be separated. For example, some functional modules shown separately in FIG. 4 could be implemented in a single module and the various functions of single functional blocks (e.g., metric calculator module 302) could be implemented by one or more functional blocks in various implementations. The actual number of modules and the division of particular functions used to implement the voice signal enhancement system 400 and how features are allocated among them will vary from one implementation to another, and may depend in part on the particular combination of hardware, software and/or firmware chosen for a particular implementation.

Figure 5:
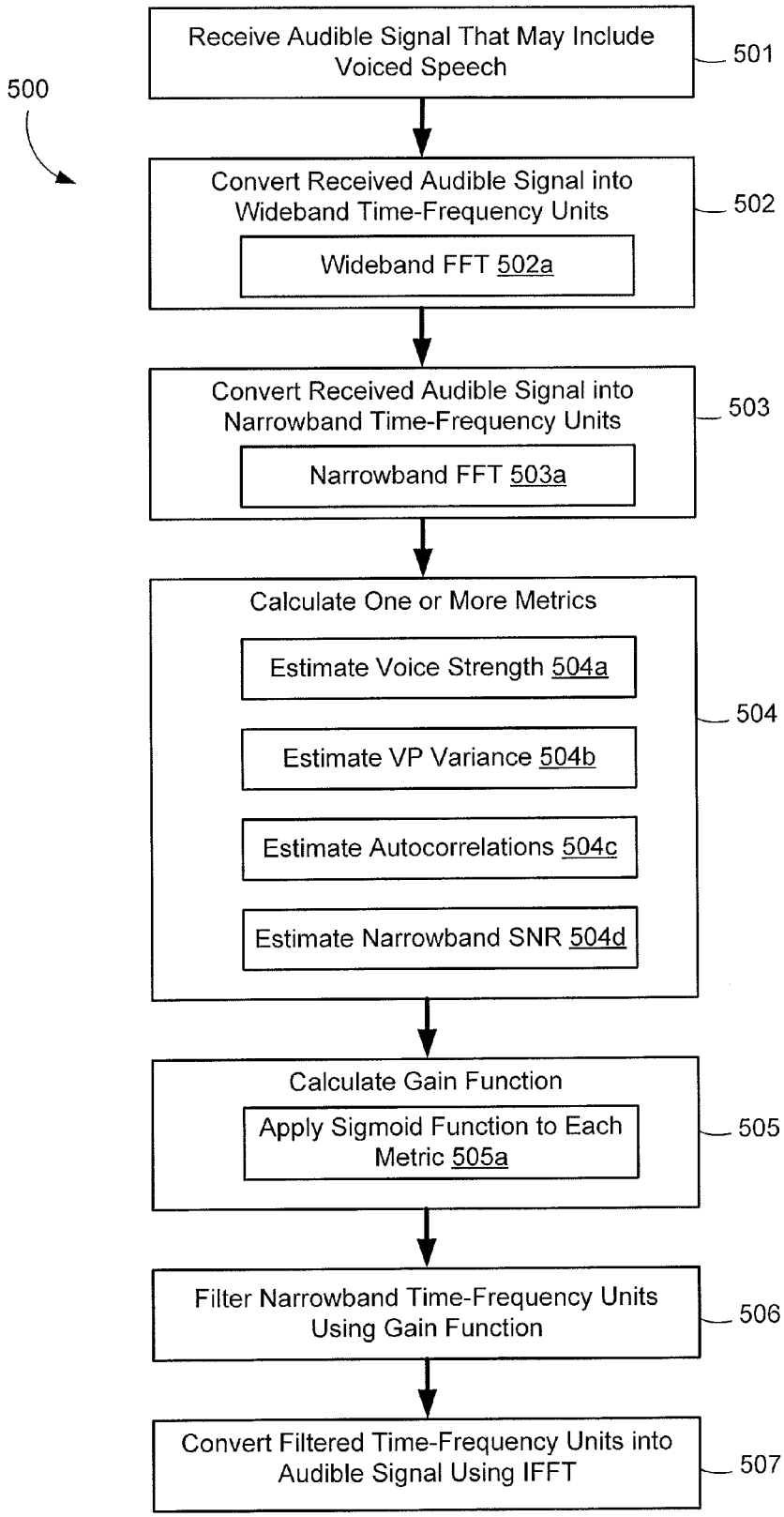
FIG. 5 is a flowchart representation of an implementation of a voice signal enhancement system method.

FIG. 5 is a flowchart 500 representation of an implementation of a voice signal enhancement system method. In some implementations, the method is performed by a hearing aid or the like in order to accentuate a target voice signal identified in an audible signal. To that end, the method includes receiving an audible signal (501), and converting the received audible signal into a number of wideband time-frequency units, such that the time dimension of each wideband time-frequency unit includes at least one of a plurality of sequential intervals (502), and the frequency dimension of each wideband time-frequency unit includes at least one of a plurality of wideband sub-bands contiguously distributed throughout the frequency spectrum associated with human speech. In some implementations, the conversion includes utilizing a wideband FFT (502*a*).

The method also includes converting the received audible signal into a number of narrowband time-frequency units (503), such that the time dimension of each narrowband time-frequency unit includes at least one of a plurality of sequential intervals, and the frequency dimension of each narrowband time-frequency unit includes at least one of a plurality of narrowband sub-bands contiguously distributed throughout the frequency spectrum associated with human speech. In some implementations, the conversion includes utilizing a narrowband FFT (503*a*).

Using the various time-frequency units, the method includes calculating one or more metrics (504). For example, using the wideband time-frequency units, in some implementations, the method includes at least one or estimating the voice strength (504*a*), estimating the voice pitch variance (504*b*), and estimating sub-band autocorrelations (504*c*). Additionally and/or alternatively, using the narrowband time-frequency units, in some implementations, the method includes estimating the SNR for one or more of the narrowband sub-bands (504*d*).

Using the one or more metrics, the method includes calculating a gain function (505). In some implementations, calculating the gain function includes applying a sigmoid function to each of the one or more metrics to obtain a respective gain value (505*a*). In turn, the method includes filtering the narrowband time-frequency units using the one or more gain values or functions (506). In some implementations, the respective gain values are applied individually, in combination depending on time and/or frequency, or combined and applied together as a single gain function. Subsequently, the method includes converting the filtered narrowband time-frequency units back into an audible signal (507).

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, which changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. A method of discriminating relative to a voice signal, the method comprising:

receiving, via one or more audible sensors, an audible signal including a target voice signal;

converting the audible signal into a corresponding plurality of wideband time-frequency units, wherein the time dimension of each time-frequency unit includes at least one of a plurality of sequential intervals, and wherein the frequency dimension of each time-frequency unit includes at least one of a plurality of wide sub-bands;

calculating one or more characterizing metrics from the plurality of wideband time-frequency units;

calculating a gain function from one or more characterizing metrics calculated from the plurality of wideband time-frequency units;

converting the audible signal into a corresponding plurality of narrowband time-frequency units;

applying the gain function, calculated from the plurality of wideband time-frequency units, to the plurality of narrowband time-frequency units to produce a corresponding plurality of narrowband gain-corrected time-frequency units;

converting the plurality of narrowband gain-corrected time-frequency units into a corrected audible signal, wherein the corrected audible signal includes an improved target voice signal relative to the received audible signal; and outputting the corrected audible signal through an output device.

2. The method of claim 1, further comprising receiving the audible signal from a single audio sensor device.

3. The method of claim 1, further comprising receiving the audible signal from a plurality of audio sensors.

4. The method of claim 1, wherein the plurality of wide sub-bands is contiguously distributed throughout the frequency spectrum associated with human speech.

5. The method of claim 1, wherein converting the audible signal into the corresponding plurality of wideband time-frequency units includes applying a Fast Fourier Transform to the audible signal.

6. The method of claim 1, wherein the one or more characterizing metrics comprises:

a strength metric associated the number of glottal pulses identified in the plurality of wideband time-frequency units;

a relative period value indicative of how far an identified period in a respective wide sub-band is from an identified dominant period; and an autocorrelation coefficient associated with an identified glottal pulse in a respective sub-band.

7. The method of claim 6, wherein one or more of the strength metric, the relative period value and the autocorrelation coefficient are determined from one or more outputs of a voice activity detector.

8. The method of claim 1, further comprising calculating a respective signal-to-noise ratio for each narrow sub-band, and wherein the respective signal-to-noise ratios are included in the calculation of the gain function.

9. The method of claim 1, wherein converting the plurality of narrowband gain-corrected time-frequency units into the corrected audible signal comprises re-synthesizing the audible signal from the plurality of narrowband gain-corrected time-frequency units using an inverse Fast Fourier Transform.

10. The method of claim 1, wherein calculating the gain function includes utilizing a sigmoid function to covert one or more of the characterizing metrics into a respective gain.

11. A method of discriminating against far field audible components, the method comprising:

receiving, via one or more audible sensors, an audible signal including a target voice signal;

converting the audible signal into a corresponding plurality of time-frequency units, wherein the time dimension of each time-frequency unit includes at least one of a plurality of sequential intervals, and wherein the frequency dimension of each time-frequency unit includes at least one of a plurality of sub-bands;

calculating one or more characterizing metrics from the plurality of time-frequency units associated with near field audible components;

calculating a discriminating function from one or more characterizing metrics calculated from the plurality of wideband time-frequency units;

applying the discriminating function, calculated from the plurality of wideband time-frequency units, to the plurality of time-frequency units to produce a corresponding plurality of corrected time-frequency units;

converting the plurality of corrected time-frequency units into a corrected audible signal, wherein the corrected audible signal includes an improved target voice signal relative to the received audible signal; and outputting the corrected audible signal through an output device.

12. A voice signal enhancement device to discriminate relative to a voice signal, the device comprising:

one or more audio sensors configured to receive and audible signal including a target voice signal;

a first conversion module configured to convert the audible signal into a corresponding plurality of wideband time-frequency units, wherein the time dimension of each time-frequency unit includes at least one of a plurality of sequential intervals, and wherein the frequency dimension of each time-frequency unit includes at least one of a plurality of wide sub-bands;

a second conversion module configured to convert the audible signal into a corresponding plurality of narrowband time-frequency units;

a metric calculator configured to calculate one or more characterizing metrics from the plurality of wideband time-frequency units;

a gain calculator configured to calculate a gain function from one or more characterizing metrics calculated from the plurality of wideband time-frequency units;

a filtering module configured to apply the gain function, calculated from the plurality of wideband time-frequency units, to the plurality of narrowband time-frequency units to produce a corresponding plurality of narrowband gain-corrected time-frequency units;

a third conversion module configured to convert the plurality of narrowband gain-corrected time-frequency units into a corrected audible signal, wherein the corrected audible signal includes an improved target voice signal relative to the received audible signal; and an output device configured to output the corrected audible signal.

13. The device of claim 12, further comprising an audio sensor to receive the audible signal.

14. The device of claim 12, wherein at least one of the first conversion module and the second conversion module utilizes a Fast Fourier Transform.

15. The device of claim 12, wherein the third conversion module utilizes an Inverse Fast Fourier Transform.

16. The device of claim 12, wherein the metric calculator is operable to determine at least one of:

a strength metric associated the number of glottal pulses identified in the plurality of wideband time-frequency units;

a relative period value indicative of how far an identified period in a respective wide sub-band is from an identified dominant period; and an autocorrelation coefficient associated with an identified glottal pulse in a respective sub-band.

17. The device of claim 16, further comprising a voice activity detector, and wherein one or more of the strength metric, the relative period value and the autocorrelation coefficient are determined from one or more outputs of the voice activity detector.

18. The device of claim 12, further comprising a narrowband signal-to-noise estimator to determine a respective signal-to-noise ratio for each narrow sub-band, and wherein the respective signal-to-noise ratios are included in the calculation of the gain function.

19. A voice signal enhancement device to discriminate relative to a voice signal, the device comprising:

means for receiving an audible signal including a target voice signal;

means for converting the audible signal into a corresponding plurality of wideband time-frequency units, wherein the time dimension of each time-frequency unit includes at least one of a plurality of sequential intervals, and wherein the frequency dimension of each time-frequency unit includes at least one of a plurality of wide sub-bands;

means for converting the audible signal into a corresponding plurality of narrowband time-frequency units;

means for calculating one or more characterizing metrics from the plurality of wideband time-frequency units;

means for calculating gain function from one or more characterizing metrics calculated from the plurality of wideband time-frequency units;

means for applying the gain function, calculated from the plurality of wideband time-frequency units, to the plurality of narrowband time-frequency units to produce a corresponding plurality of narrowband gain-corrected time-frequency units;

means for converting the plurality of narrowband gain-corrected time-frequency units into a corrected audible signal, wherein the corrected audible signal includes an improved target voice signal relative to the received audible signal; and means for outputting the corrected audible signal.

20. A voice signal enhancement device to discriminate relative to a voice signal, the device comprising:

one or more audio sensors configured to receive and audible signal including a target voice signal;

a processor;

a memory including instructions, that when executed by the processor cause the device to:

convert an audible signal into a corresponding plurality of wideband time-frequency units, wherein the time dimension of each time-frequency unit includes at least one of a plurality of sequential intervals, and wherein the frequency dimension of each time-frequency unit includes at least one of a plurality of wide sub-bands;

convert the audible signal into a corresponding plurality of narrowband time-frequency units;

calculate one or more characterizing metrics from the plurality of wideband time-frequency units;

calculate gain function from one or more characterizing metrics calculated from the plurality of wideband time-frequency units;

apply the gain function, calculated from the plurality of wideband time-frequency units, to the plurality of narrowband time-frequency units to produce a corresponding plurality of narrowband gain-corrected time-frequency units;

convert the plurality of narrowband gain-corrected time-frequency units into a corrected audible signal, wherein the corrected audible signal includes an improved target voice signal relative to the received audible signal; and output the corrected audible signal through an output device.

* * * * *